US008570257B2

(12) United States Patent
Yamashita et al.

(10) Patent No.: US 8,570,257 B2
(45) Date of Patent: Oct. 29, 2013

(54) DISPLAY DEVICE THAT SETS A VALUE OF A POWER SUPPLY VOLTAGE TO COMPENSATE FOR CHANGES IN LIGHT EMITTING ELEMENT I/V CHARACTERISTICS

(75) Inventors: Junichi Yamashita, Tokyo (JP); Katsuhide Uchino, Kanagawa (JP)

(73) Assignee: Sony Corporation, Tokyo (JP)

( * ) Notice: Subject to any disclaimer, the term of this patent is extended or adjusted under 35 U.S.C. 154(b) by 371 days.

(21) Appl. No.: 12/926,327

(22) Filed: Nov. 10, 2010

(65) Prior Publication Data

US 2011/0134101 A1 Jun. 9, 2011

(30) Foreign Application Priority Data

Dec. 7, 2009 (JP) ..... 2009-277814

(51) Int. Cl.
*G09G 3/30* (2006.01)

(52) U.S. Cl.
USPC ..... 345/78; 345/212

(58) Field of Classification Search
USPC ..... 345/76–78, 212
See application file for complete search history.

(56) References Cited

U.S. PATENT DOCUMENTS

| | | | | |
|---|---|---|---|---|
| 6,583,775 | B1 | 6/2003 | Sekiya et al. | |
| 2009/0027316 | A1* | 1/2009 | Kim | 345/80 |
| 2009/0027374 | A1* | 1/2009 | Kohno et al. | 345/212 |
| 2010/0103203 | A1* | 4/2010 | Choi | 345/690 |

FOREIGN PATENT DOCUMENTS

JP 2001-060076 A 3/2001

* cited by examiner

*Primary Examiner* — Chanh Nguyen
*Assistant Examiner* — Long D Pham
(74) *Attorney, Agent, or Firm* — Rader, Fishman & Grauer PLLC

(57) ABSTRACT

A display device that may be controlled to be reduced in power consumption, a method of driving the display device, and an electronic device having the display device are provided. The display device includes: a display section including a display region in which a plurality of display pixels are arranged two-dimensionally, the display pixels having first light emitting elements, and a non-display region in which one or multiple adjustment pixels are arranged, each adjustment pixel having a second light emitting element; and a drive section driving each display pixel based on a video signal, and driving the adjustment pixel based on a fixed signal. The drive section applies a power-supply voltage, having a value corresponding to voltage variation in the second light emitting element when the second light emitting element emits light, to each display pixel.

13 Claims, 11 Drawing Sheets

| | INITIAL STATE | AFTER I-V CHARACTERISTIC CHANGE |
|---|---|---|
| $V_{el}$ (V) | 6 | 7 |
| $V_{ds}$ (V) | 3 | 3 |
| $V_{cc}$ | 9 | 10 |
| $\Delta V$ | 0 | 1 |
FIG. 9
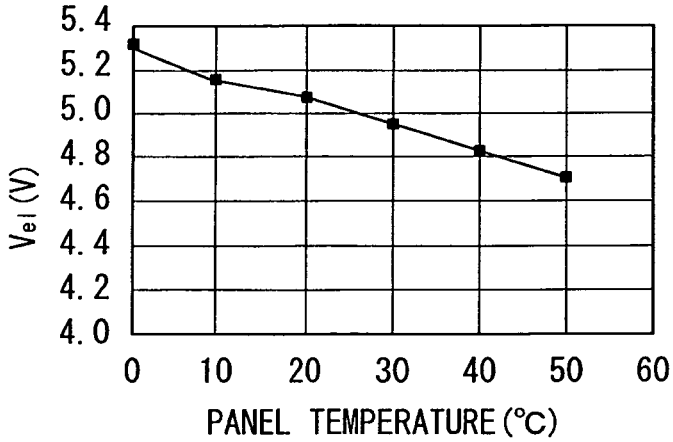
FIG. 10
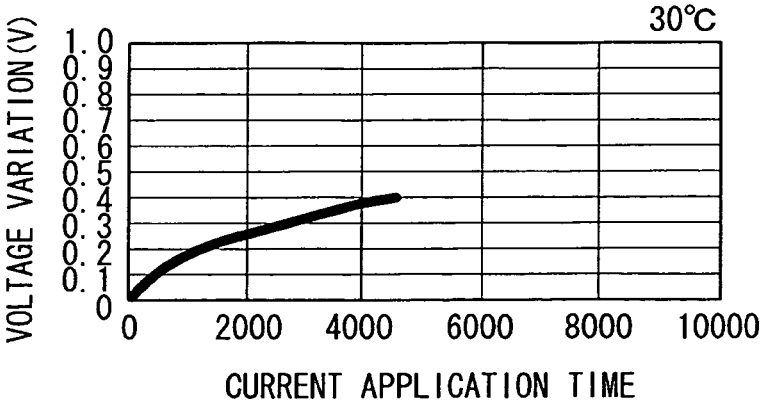
FIG. 11

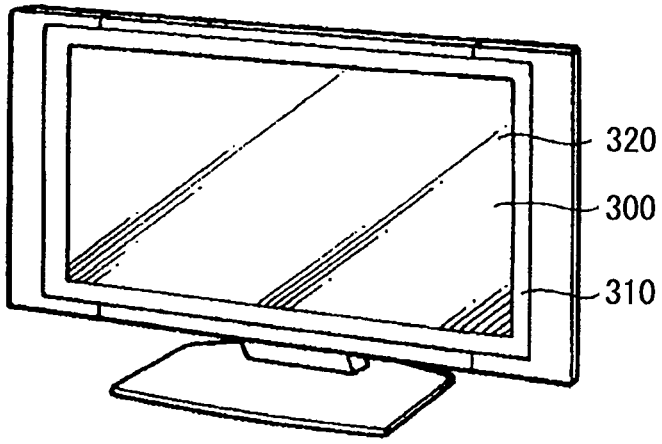
FIG. 13
FIG. 14A
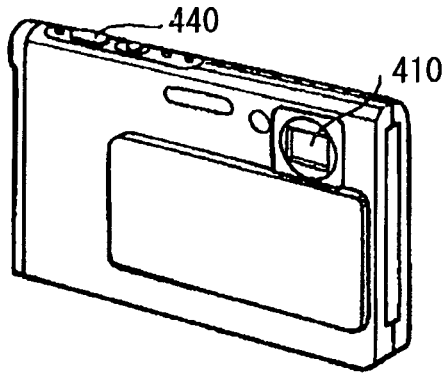
FIG. 14B
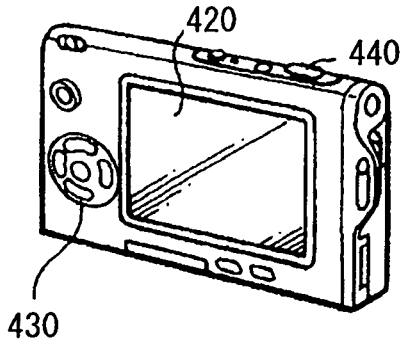

DISPLAY DEVICE THAT SETS A VALUE OF A POWER SUPPLY VOLTAGE TO COMPENSATE FOR CHANGES IN LIGHT EMITTING ELEMENT I/V CHARACTERISTICS

BACKGROUND OF THE INVENTION

1. Field of the Invention

The present invention relates to a display device including a display panel having light emitting elements therein, and a method of driving the display device. In addition, the invention relates to an electronic device having the display device.

2. Description of Related Art

Recently, a display device using a current-drive optical element as a light emitting element in a pixel, the optical element being changed in emission luminance in accordance with a value of electric current flowing into the optical element, for example, an organic EL (Electro Luminance) element, has been developed and commercialized in a field of display devices for image display. The organic EL element is a self-luminous element unlike a liquid crystal element or the like. Therefore, a display device using the organic EL element (organic EL display device) does not need a light source (backlight) and therefore may be made small in thickness and high in luminance compared with a liquid crystal display device that needs a light source. In particular, use of active matrix as a drive method enables hold-lighting of each pixel, leading to low power consumption. Therefore, the organic EL display device is expected to become a mainstream of next-generation flat panel display.

The organic EL element, which is a current-drive light emitting element, may be adjusted in gray level by controlling the amount of current flowing into the organic EL element. However, in the organic EL element, an I-V characteristic varies depending on current application time or temperature of the element. Therefore, a drive transistor, which controls the amount of current flowing into the organic EL element, is constantly driven in a saturated region so that even if the I-V characteristic is temporally changed, constant luminance may be obtained (see Japanese Unexamined Patent Application Publication No. 2001-60076).

SUMMARY OF THE INVENTION

In a situation where the I-V characteristic of the organic EL element temporally varies, in order to constantly drive the drive transistor in a saturated region, power-supply voltage needs to be set to a value high enough to prevent the drive transistor from being linearly driven due to variation in the I-V characteristic of the organic EL element. For example, when inter-terminal voltage of the organic EL element is expected to increase by about 2 V due to variation in the I-V characteristic of the element, power-supply voltage is likely to be beforehand set to a value having a margin of about 2 V. However, when power-supply voltage is beforehand provided with a margin, power consumption has disadvantageously increased in correspondence to such a margin.

It is desirable to provide a display device that may be controlled to be reduced in power consumption, a method of driving the display device, and an electronic device having the display device.

A display device according to an embodiment of the invention includes a display section including a display region in which a plurality of display pixels are arranged two-dimensionally, the display pixels having first light emitting elements, and a non-display region in which one or multiple adjustment pixels are arranged, each adjustment pixel having a second light emitting element, and includes a drive section driving each display pixel based on a video signal, and driving the adjustment pixel based on a fixed signal. The drive section applies a power-supply voltage, having a value corresponding to voltage variation in the second light emitting element when the second light emitting element emits light, to each display pixel.

An electronic device according to an embodiment of the invention includes the above-mentioned display device.

A method of driving a display device according to an embodiment of the invention, the display device including a display section including a display region in which a plurality of display pixels are arranged two-dimensionally, the display pixels having first light emitting elements, and a non-display region in which one or multiple adjustment pixels are arranged, each adjustment pixel having a second light emitting element, includes the following two steps:

(1) driving each display pixel based on a video signal and driving the adjustment pixel based on a fixed signal; and (2) applying a power-supply voltage, having a value corresponding to voltage variation in the second light emitting element when the second light emitting element emits light, to each display pixel.

In the display device, the method of driving the display device, and the electronic device according to the embodiment of the invention, a power-supply voltage is applied to each display pixel, the power-supply voltage having a value corresponding to voltage variation in the second light emitting element in the adjustment pixel, which is driven based on a fixed signal, when the second light emitting element emits light. Thus, a value of power-supply voltage may be set small compared with a case where power-supply voltage is beforehand provided with a margin corresponding to predicted voltage variation in a light emitting element.

According to the display device, the method of driving the display device, and the electronic device of the embodiment of the invention, a value of a power-supply voltage may be set small compared with a case where power-supply voltage is beforehand provided with a margin corresponding to predicted voltage variation in a light emitting element. Thus, power consumption may be controlled to be low.

Other and further objects, features and advantages of the invention will appear more fully from the following description.

BRIEF DESCRIPTION OF THE DRAWINGS

FIG. 9 is a relationship diagram showing an example of a relationship between voltage of an organic EL element and drain-to-source voltage of a drive transistor.

FIG. 10 is a relationship diagram showing an example of a relationship between panel temperature and voltage of an organic EL element.

FIG. 11 is a relationship diagram showing an example of a relationship between current application time to an organic EL element and voltage variation in the organic EL element.

FIG. 13 is a perspective diagram showing appearance of application example 1 of the display device according to the embodiment.

FIGS. 14A and 14B are perspective diagrams, where FIG. 14A shows appearance of application example 2 as viewed from a surface side, and FIG. 14B shows appearance thereof as viewed from a back side.

FIG. 17A is a front diagram of the example 5 in an opened state, FIG. 17B is a side diagram thereof, FIG. 17C is a front diagram thereof in a closed state, FIG. 17D is a left side diagram thereof, FIG. 17E is a right side diagram thereof, FIG. 17F is a top diagram thereof, and FIG. 17G is a bottom diagram thereof.

DETAILED DESCRIPTION OF THE PREFERRED EMBODIMENTS

Hereinafter, a preferred embodiment of the invention will be described in detail with reference to drawings. Description is made in the following sequence.

1. Embodiment (FIGS. 1 to 12)
2. Application Examples (FIGS. 13 to 17G)

Embodiment

Schematic Configuration of Display Device 1

Figure 1:
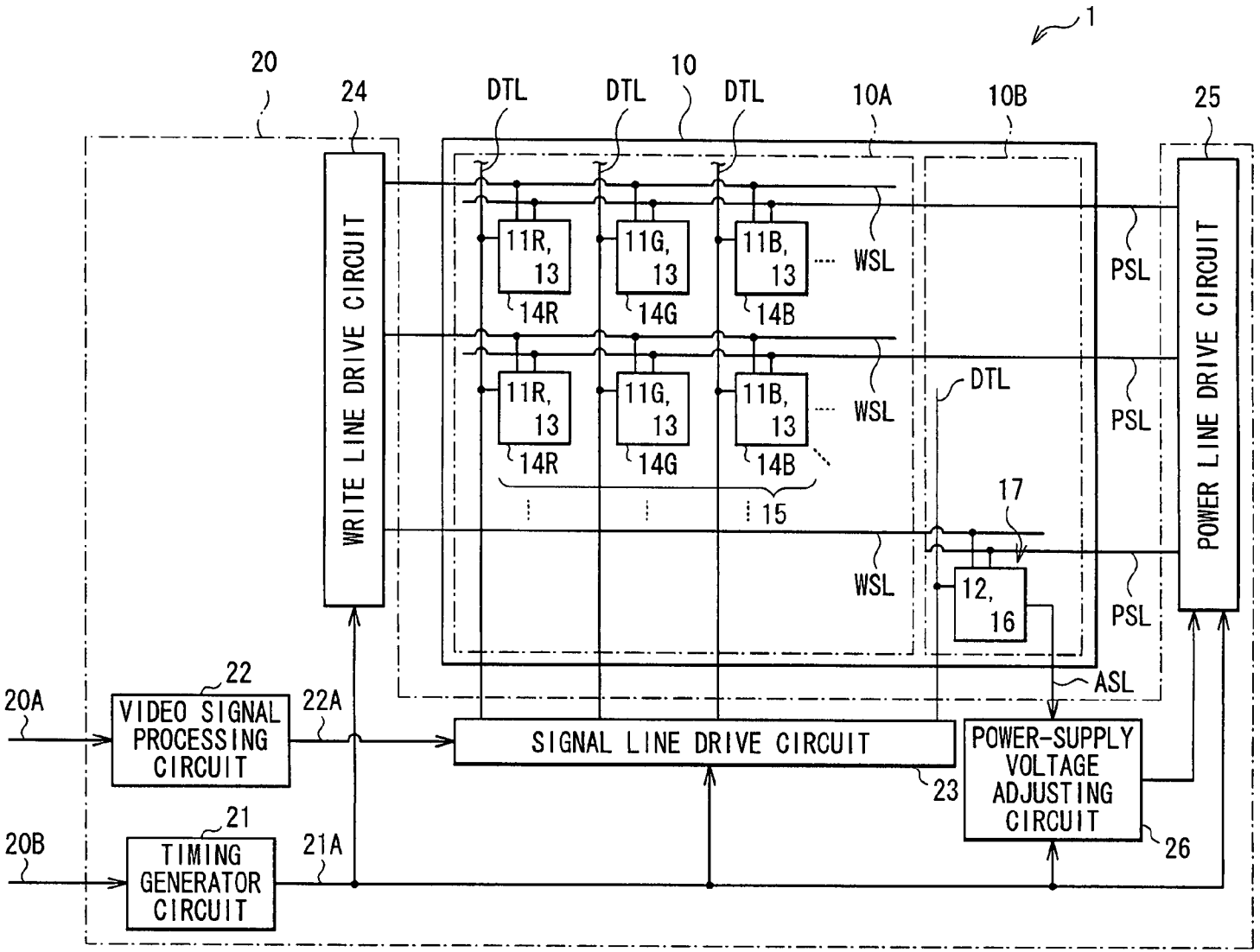
FIG. 1 is a schematic diagram showing an example of a configuration of a display device according to an embodiment of the invention.

FIG. 1 shows a schematic configuration of a display device 1 according to an embodiment of the invention. The display device 1 includes a display panel 10 (display section) and a drive circuit 20 (drive section) for driving the display panel 10.

The display panel 10 has a display region 10A having a plurality of organic EL elements 11R, 11G and 11B (first light emitting elements) arranged two-dimensionally therein. Hereinafter, a term, organic EL element 11, is appropriately used as a general term of the organic EL elements 11R, 11G and 11B. The display panel 10 further has a non-display region 10B having an organic EL element 12 (second light emitting element) disposed therein. The organic EL element 12 emits light of the same emission color as that of one of the organic EL elements 11R, 11G and 11B, or emits light of a color different from emission colors of the organic EL elements 11R, 11G and 11B (for example, white light).

The drive circuit 20 has a timing generator circuit 21, a video signal processing circuit 22, a signal line drive circuit 23, a write line drive circuit 24, a power line drive circuit 25, and a power-supply voltage adjusting circuit 26.

Display Pixel 15

Figure 2:
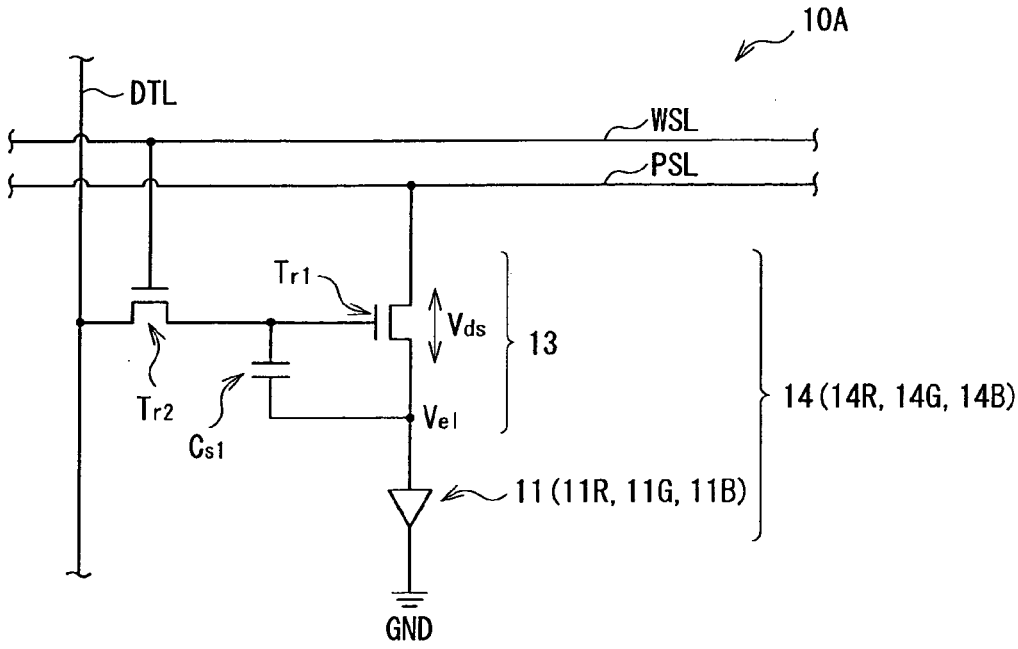
FIG. 2 is a schematic diagram showing an example of a configuration of a pixel circuit in a display region.

FIG. 2 shows an example of a circuit configuration in the display region 10A. In the display region 10A, a plurality of pixel circuits 13 coupled with the organic EL elements 11 are two-dimensionally arranged. In the embodiment, an organic EL element 11 coupled with a pixel circuit 13 configure one sub pixel 14. Specifically, as shown in FIG. 1, an organic EL element 11R coupled with a pixel circuit 13 configure one sub pixel 14R, an organic EL element 11G coupled with a pixel circuit 13 configure one sub pixel 14G, and an organic EL element 11B coupled with a pixel circuit 13 configure one sub pixel 14B. Furthermore, three sub pixels 14R, 14G and 14B adjacent to one another configure one pixel (display pixel 15).

Each pixel circuit 13 is configured of, for example, a drive transistor $Tr_1$ (first transistor), a write transistor $Tr_2$ (second transistor), and a capacitance $C_{s1}$, and thus has a configuration of 2Tr1C. The drive transistor $Tr_1$ and the write transistor $Tr_2$ are, for example, formed of an n-channel MOS thin-film transistor (TFT) each. The drive transistor $Tr_1$ or the write transistor $Tr_2$ may be, for example, a p-channel MOS TFT.

In the display region 10A, a plurality of signal lines DTL are disposed in a column direction, and a plurality of scan lines WSL and a plurality of power lines PSL (members for supplying power-supply voltage) are disposed in a row direction respectively. One organic EL element 11 is provided near each of intersections between the signal lines DTL and the scan lines WSL. Each signal line DTL is connected to an output end (not shown) of the signal line drive circuit 23 and one of drain and source electrodes (not shown) of the write transistor $Tr_2$. Each scan line WSL is connected to an output end (not shown) of the write line drive circuit 24 and a gate electrode (not shown) of the write transistor $Tr_2$. Each power line PSL is connected to an output end (not shown) of the power line drive circuit 25 and one of drain and source electrodes (not shown) of the drive transistor $Tr_1$. The other of the drain and source electrodes (not shown), being not connected to the signal line DTL, of the write transistor $Tr_2$ is connected to a gate electrode (not shown) of the drive transistor $Tr_1$ and one end of the capacitance $C_{s1}$. The other of the drain and source electrodes (not shown), being not connected to the power line PSL, of the drive transistor $Tr_1$ and the other end of the capacitance $C_{s1}$ are connected to an anode electrode (not shown) of the organic EL element 11. A cathode electrode (not shown) of the organic EL element 11 is connected to, for example, a ground line GND.

Adjustment Pixel 17

Figure 3:
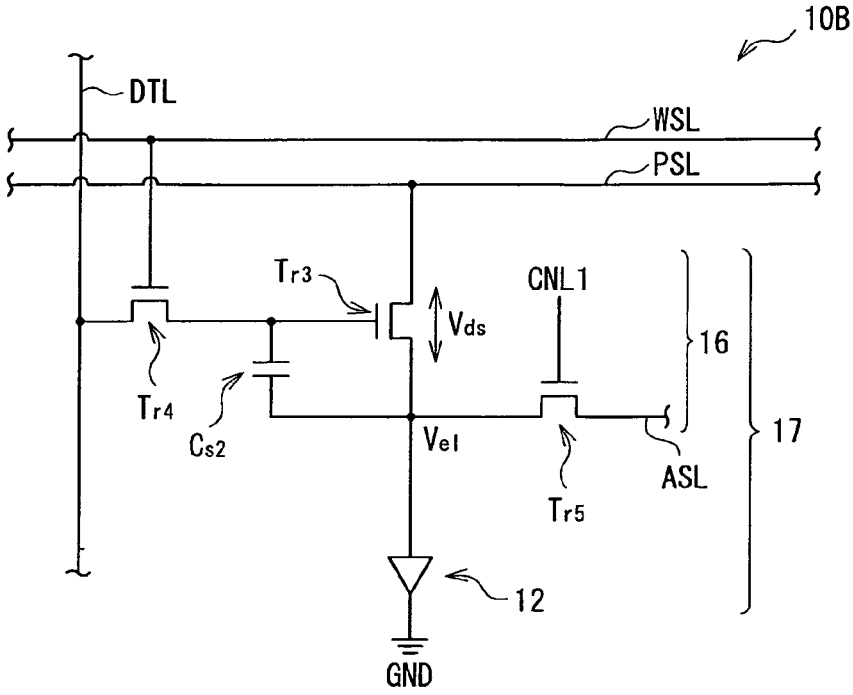
FIG. 3 is a schematic diagram showing an example of a configuration of a pixel circuit in a non-display region.

FIG. 3 shows an example of a circuit configuration in the non-display region 10B. One pixel circuit 16 is coupled with the organic EL element 12 in the non-display region 10B. In the embodiment, the organic EL element 12 coupled with the pixel circuit 16 configure one pixel (adjustment pixel 17).

The pixel circuit 16 has the same configuration as the pixel circuit 13. Specifically, the pixel circuit 16 is configured of a drive transistor $Tr_3$, a write transistor $Tr_4$, and a capacitance $C_{s2}$, and thus has a configuration of 2Tr1C. The drive transistor $Tr_3$ and the write transistor $Tr_4$ are, for example, formed of an n-channel MOS TFT each. The drive transistor $Tr_3$ or the write transistor $Tr_4$ may be, for example, a p-channel MOS TFT. The pixel circuit 16 further has a transistor $Tr_5$ for on/off control of output to an anode signal line ASL (voltage $V_{el}$ of the organic EL element 11).

In the non-display region 10B, one signal line DTL is disposed in a column direction, and one scan line WSL and one power line PSL are disposed in a row direction, respectively. An organic EL element 12 is provided near an intersection between the signal line DTL and the scan line WSL. The signal line DTL is connected to one of a drain electrode and a source electrode (not shown) of the write transistor $Tr_4$. The scan line WSL is connected to an output end (not shown) of the write line drive circuit 24 and a gate electrode (not shown) of the write transistor $Tr_4$. Each power line PSL is connected to an output end (not shown) of the power line drive circuit 25 and one of drain and source electrodes (not shown) of the drive transistor $Tr_3$. The other of the drain and source electrodes (not shown), being not connected to the signal line DTL, of the write transistor $Tr_4$ is connected to a gate electrode (not shown) of the drive transistor $Tr_3$ and one end of the capacitance $C_{s2}$. The other of the drain and source electrodes (not shown), being not connected to the power line PSL, of the drive transistor $Tr_3$ and the other end of the capacitance $C_{s2}$ are connected to an anode electrode (not shown) of the organic EL element 12. A cathode electrode (not shown) of the organic EL element 12 is connected to, for example, the ground line GND. The anode electrode of the organic EL element 12 is connected with one end of the anode signal line ASL. The other end of the anode signal line ASL is connected to the power-supply voltage adjusting circuit 26. The transistor $Tr_5$ (switching element) is inserted in the anode signal line ASL, and a gate electrode (not shown) of the transistor $Tr_5$ is connected to one end of a control line CNL1. The other end of the control line CNL1 is connected to the timing generation circuit 21.

Top Configuration of Display Panel 10

Figure 4:
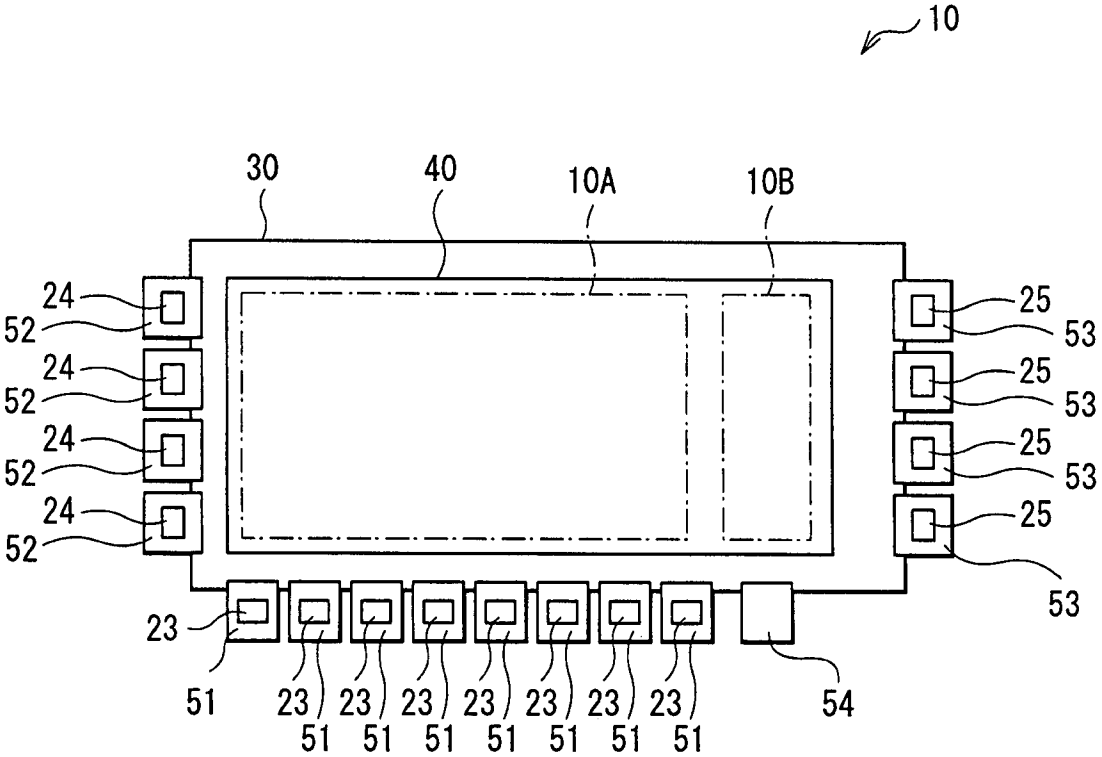
FIG. 4 is a top diagram showing an example of a configuration of a display panel in FIG. 1.

FIG. 4 shows an example of a top configuration of the display panel 10. The display panel 10 has, for example, a structure where a drive panel 30 and a seal panel 40 are attached to each other via a sealing layer (not shown).

While not shown in FIG. 4, the drive panel 30 has a display region 10A having a plurality of organic EL elements 11 arranged two-dimensionally therein and a plurality of pixel circuits 13 disposed adjacently to the organic EL elements 11. While not shown in FIG. 4, the drive panel 30 further has a non-display region 10B having one organic EL element 12 disposed therein and one pixel circuit 16 disposed adjacently to the organic EL element 12.

One of sides (long sides) of the drive panel 30 is, for example, attached with a plurality of video signal supply TAB 51 and a signal input/output TCP 54 as shown in FIG. 4. One of other sides (short sides) of the drive panel 30 is, for example, attached with scan signal supply TAB 52. The other short side of the drive panel 30, which is different from the side attached with the supply TAB 52, is, for example, attached with power-supply voltage supply TAB 53. The video signal supply TAB 51 is configured such that IC including the signal line drive circuit 23 is interconnected with an air gap on an opening of a film-like wiring substrate. The scan signal supply TAB 52 is configured such that IC including the write line drive circuit 24 is interconnected with an air gap on an opening of a film-like wiring substrate. The power-supply voltage supply TAB 53 is configured such that IC including the power line drive circuit 25 is interconnected with an air gap on an opening of a film-like wiring substrate. The power-supply voltage supply TAB 53 is connected to an output end (not shown) of the power-supply voltage adjusting circuit 26. An anode signal input/output TCP 54 is connected to an input end (not shown) of the power-supply voltage adjusting circuit 26. The signal line drive circuit 23, the write line drive circuit 24, and the power line drive circuit 25 may not be formed on TAB, and, for example, may be formed on the drive panel 30.

The seal panel 40 has, for example, a seal substrate (not shown) for sealing the organic EL elements 11 and 12, and a color filter (not shown). The color filter is provided in a region, through which light from the organic EL element 11 may transmit, of a surface of the seal substrate. The color filter has, for example, a red filter, a green filter, and a blue filter (not shown) in correspondence to the organic EL elements 11R, 11G and 11B, respectively.

Drive Circuit 20

Next, circuits in the drive circuit 20 will be described with reference to FIG. 1. The timing generator circuit 21 operates to control the video signal processing circuit 22, the signal line drive circuit 23, the write line drive circuit 24, the power line drive circuit 25, and the power-supply voltage adjusting circuit 26 such that the circuits operate in conjunction with one another.

For example, the timing generator circuit 21 outputs a control signal 21A to each of the circuits in response to (in synchronization with) a synchronizing signal 20B inputted from the outside. For example, the timing generator circuit 21 is formed on a control circuit substrate (not shown), which is separated from the display panel 10, together with the video signal processing circuit 22 and the power-supply voltage adjusting circuit 26. The timing generator circuit 21 outputs a control signal 21A to the adjustment pixel 17 via the control line CNL1. Specifically, the timing generator circuit 21 operates such that the transistor $Tr_5$ is on only (within a period) when the organic EL element 12 in the adjustment pixel 17 emits light, and the transistor $Tr_5$ is off at least when the organic EL element 12 in the adjustment pixel 17 does not emit light.

For example, the video signal processing circuit 22 corrects a digital video signal 20A inputted from the outside in response to (in synchronization with) a synchronizing signal 20B inputted from the outside, and converts such a corrected video signal into an analog signal, and outputs the analog signal as an analog video signal 22A to the signal line drive circuit 23. The video signal processing circuit 22 extracts a video signal having a maximum luminance from among video signals 20A of one field (or corrected video signals), and outputs such an extracted video signal as a video signal for the adjustment pixel 17 to the signal line drive circuit 23. For example, the video signal processing circuit 22 extracts a video signal 20A having a maximum luminance from among video signals 20A of one field (or corrected video signals) every one horizontal period.

The signal line drive circuit 23 outputs the analog video signal 22A inputted from the video signal processing circuit 22 to each signal line DTL in response to (in synchronization with) an inputted control signal 21A so that each display pixel 15 and the adjustment pixel 17 are driven. The signal line drive circuit 23 outputs a video signal 22A corrected by the video signal processing circuit 22 to a signal line DTL corresponding to the display pixel 15. The signal line drive circuit 23 outputs a video signal 22A with a fixed voltage value (fixed signal) to a signal line DTL corresponding to the adjustment pixel 17. That is, the signal line drive circuit 23 writes the analog video signal 22A (signal voltage) into a gate of the drive transistor $Tr_1$ in each display pixel 15 and a gate of the drive transistor $Tr_3$ in the adjustment pixel 17. The signal line drive circuit 23 is, for example, provided on the video signal supply TAB 51 attached to one side (long side) of the drive panel 30 as shown in FIG. 4.

The write line drive circuit 24 sequentially selects one scan line WSL from among the plurality of scan lines WSL in response to (in synchronization with) an inputted control signal 21A. The write line drive circuit 24 is, for example, provided on the scan signal supply TAB 52 attached to one of other sides (short sides) of the drive panel 30 as shown in FIG. 4.

The power line drive circuit 25 sequentially applies a power-supply voltage having a value corresponding to a value of power-supply voltage $V_{cc}$ outputted from the power-supply voltage adjusting circuit 26 to the plurality of power lines PSL in response to (in synchronization with) an inputted control signal 21A so that start and stop of light emission of the organic EL elements 11 and 12 are controlled.

Figure 5:
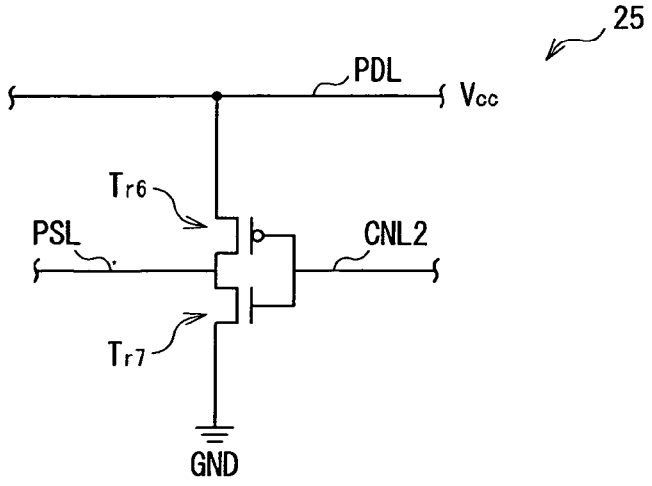
FIG. 5 is a schematic diagram showing an example of a configuration of a power line drive circuit.

For example, the power line drive circuit 25 has switching transistors $Tr_6$ and $Tr_7$ connected in series to each other between a power-supply voltage transmission line PDL provided for each power line PSL and the ground line GND as shown in FIG. 5. The power line PSL is connected to a connection between the transistors $Tr_6$ and $Tr_7$, and both gates of the transistors $Tr_6$ and $Tr_7$ are connected to a control line CNL2. The control line CNL2 is inputted with a control signal for applying the power-supply voltage $V_{cc}$ to the power line PSL only for a desired period.

Figure 6:
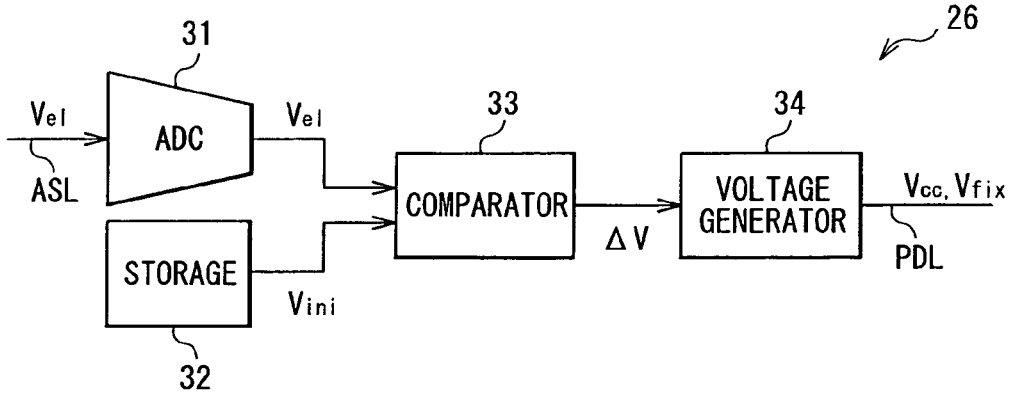
FIG. 6 is a schematic diagram showing an example of a configuration of a power-supply voltage adjusting circuit.

The power-supply voltage adjusting circuit 26 generates a power-supply voltage having a value corresponding to voltage variation in the organic EL element 12 in the adjustment pixel 17 in response to (in synchronization with) an inputted control signal 21A. For example, the power-supply voltage adjusting circuit 26 has an ADC (Analog Digital Converter) 31, a storage 32, a comparator 33, and a voltage generator 34. An input end (not shown) of the ADC 31 is connected to the anode signal line ASL as shown in FIGS. 3 and 6, and an output end (not shown) of the ADC 31 and an output end (not shown) of the storage 32 are connected to input ends (not shown) of the comparator 33. An output end (not shown) of the comparator 33 is connected to an input end (not shown) of the voltage generator 34, and an output end (not shown) of the voltage generator 34 is connected to the power-supply voltage transmission line PDL.

The ADC 31 converts an inputted analog signal (anode voltage $V_{el}$) into a digital signal. The ADC 31 acquires a voltage $V_{el}$ of the organic EL element 12 in the adjustment pixel 17 through on/off control of the transistor $Tr_5$ only when the EL element 12 emits light. A fixed voltage is outputted to the signal line DTL corresponding to the adjustment pixel 17, and a fixed voltage (power-supply voltage $V_{fix}$) is applied from the power line drive circuit 25 to a power line PSL connected to the adjustment pixel 17. Therefore, the voltage $V_{el}$ of the organic EL element 12 to be inputted into the ADC 31 has a value within a limited range. For example, when the transistors $Tr_5$ is constantly on, the ADC 31 is inputted with a voltage $V_{el}$ not only when the organic EL element 12 emits light but also when the organic EL element 12 does not emit light. Thus, since the ADC 31 is inputted with a wide range of voltage (for example, +6 to −3 V), a dynamic range of the ADC 31 is wide, for example, 9 V. Furthermore, a gray level of about seven bits is necessary for monitoring change in voltage of 0.1 V. In the embodiment, the ADC 31 is inputted with the voltage $V_{el}$ through on/off control of the transistor $Tr_5$ only when the organic EL element 12 emits light. That is, the ADC 31 monitors a voltage value of the organic EL element 12 only when the EL element 12 emits light. Thus, since the ADC 31 is inputted with a narrow range of voltage (about +5.5 to +7.5 V at most even in the light of temperature variation or temporal degradation), the dynamic range of the ADC 31 is narrow, for example, 2 V. Furthermore, a gray level of only about five bits is necessary for monitoring change in voltage of 0.1 V.

The storage 32 stores initial voltage $V_{ini}$ (reference voltage) of the organic EL element 12. The comparator 33 compares a digital signal (anode voltage $V_{el}$) inputted from the ADC 31 to the initial voltage $V_{ini}$ read from the storage 32 to derive voltage variation ΔV in the organic EL element 12 in the adjustment pixel 17. Specifically, the comparator 33 obtains a difference between the anode voltage $V_{el}$ and the initial voltage $V_{ini}$ to derive variation ΔV ($=V_{el}-V_{ini}$) of the anode voltage $V_{el}$.

The voltage generator 34 uses the voltage variation ΔV to derive a value of power-supply voltage to be applied to each display pixel 15, and applies a power-supply voltage having such a derived value to each display pixel 15 (each power-supply voltage transmission line PDL). Specifically, the voltage generator 34 uses the voltage variation ΔV to derive a power-supply voltage value necessary for driving the drive transistor $Tr_1$ in a saturated region, and applies a power-supply voltage $V_{cc}$ having such a derived value to each display pixel 15 (each power-supply voltage transmission line PDL). In other words, the voltage generator 34 applies a power-supply voltage to each display pixel 15, the voltage having a value corresponding to variation in a voltage value, which is monitored by the ADC 31, when the EL element 12 emits light. The voltage generator 34 operates for the adjustment pixel 17 to be processed in a different way from the display pixels 15. Specifically, the voltage generator 34 applies a power-supply voltage $V_{fix}$ (fixed signal) having a fixed value to the adjustment pixel 17 (power-supply voltage transmission line PDL).

Figure 7:
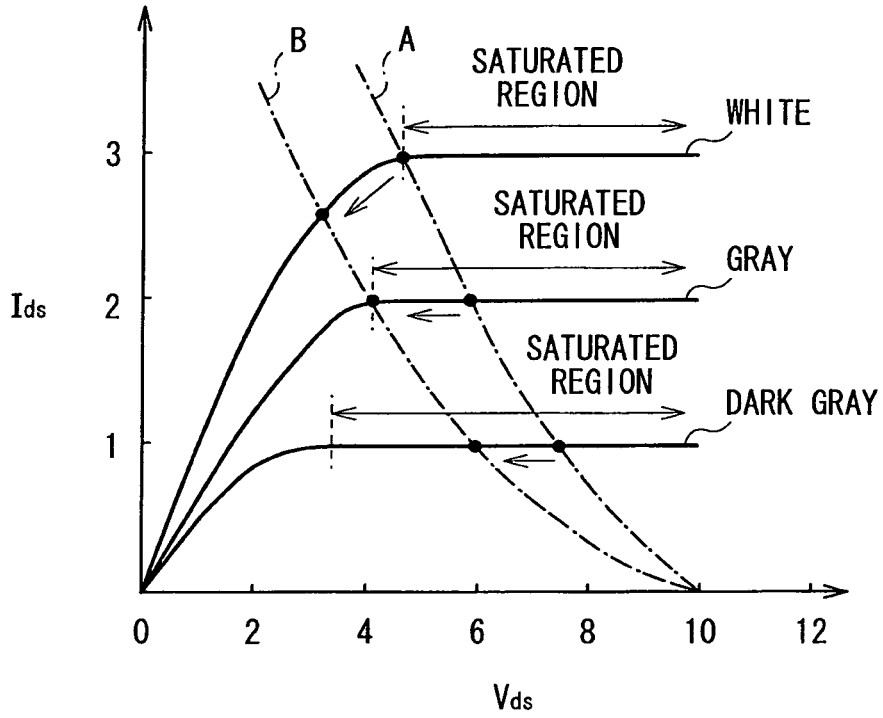
FIG. 7 is a relationship diagram showing an example of a relationship between a saturated region of a drive transistor and a gray level.
Figure 8A:
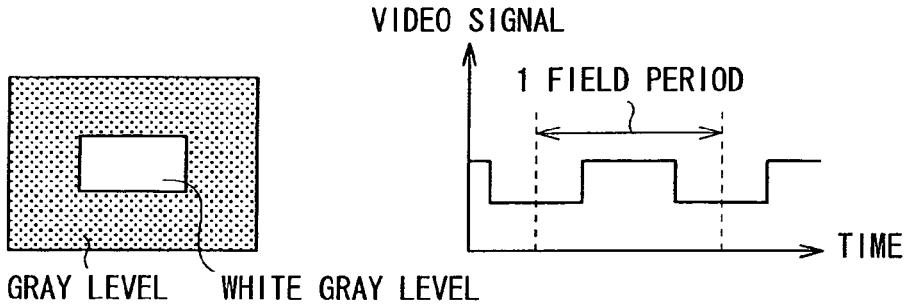
FIGS. 8A to 8C are schematic diagrams showing an example of a gray level in a display screen and an example of a video signal within one field period.
Figure 8B:
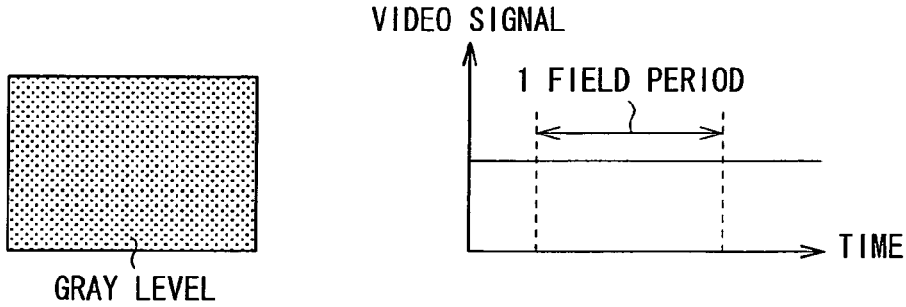
Figure 8C:
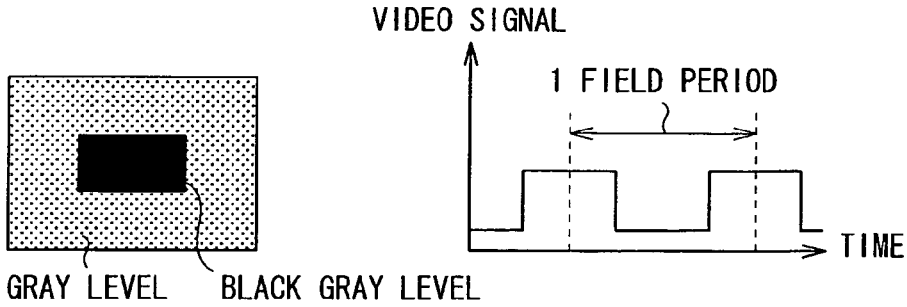

For example, the saturated region refers to a region where current $I_{ds}$ flowing into the organic EL element 11 is constant regardless of a value of drain-to-source voltage $V_{ds}$ of the drive transistor $Tr_1$ as shown in FIG. 7. In the saturated region, the current $I_{ds}$ need not be completely constant regardless of the value of drain-to-source voltage $V_{ds}$ of the drive transistor $Tr_1$. The saturated region further includes a region where change rate of the current $I_{ds}$ is gradual compared with a linear region where the current $I_{ds}$ greatly varies depending on a value of drain-to-source voltage $V_{ds}$ of the drive transistor $Tr_1$.

Operation of Display Device 1

Next, an example of operation of the display device 1 according to the invention will be described. First, a video signal 20A and a synchronizing signal 20B are inputted from the outside to the display device 1. Then, the timing generator circuit 21 outputs a control signal 21A to each of the circuits in the drive circuit 20, and each circuit in the drive circuit 20 operates according to an instruction of the control signal 21A. Specifically, the video signal processing circuit 22 generates a video signal 22A. Then, the signal line drive circuit 23 outputs the generated video signal 22A to each signal line DTL, and concurrently the write line drive circuit 24 sequentially selects one scan line WSL from among the plurality of scan lines WSL. Furthermore, the video signal processing circuit 22 generates a video signal for the adjustment pixel 17. The generated video signal 22A for the adjustment pixel 17 is outputted to a signal line DTL for the adjustment pixel 17, and concurrently the write line drive circuit 24 selects a scan line WSL for the adjustment pixel 17. Power-supply voltage having a value corresponding to voltage variation in the organic EL element 12 in the adjustment pixel 17 is outputted from the power-supply voltage adjusting circuit 26 to the power-supply voltage transmission line PDL, and the power-supply voltage outputted to the power-supply voltage transmission line PDL is then sequentially applied to the plurality of power-supply lines PSL by the power-supply line drive circuit 25. Thus, the display pixels 15 and the adjustment pixel 17 are driven, and thus a video image is displayed in the display region 10A.

Advantage of Display Device 1

Next, advantage of the display device 1 according to the embodiment will be described. As shown in FIG. 7, a lower end of the saturated region varies depending on gray levels. As a gray level becomes lower, the lower end of the saturated region shifts in such a manner that the drain-to-source voltage $V_{ds}$ of the drive transistor $Tr_1$ is decreased. Therefore, when an initial I-V characteristic of the organic EL element 11 is expressed as a curve A in the figure, as a gray level becomes higher, an operating point (black circle) tends to be closer to the lower end of the saturated region, namely, a margin between the operating point (black circle) and the lower end tends to be reduced. Therefore, when the I-V characteristic of the organic EL element 11 shifts into a curve B in the figure, the operating point is still in the saturated region in intermediate and low gray levels, but the point is in the linear region in a high gray level.

It is assumed that the voltage generator 34 sets a value of power-supply voltage $V_{cc}$ so that the operating point is in the saturated region in the high gray level regardless of values of video signals 22A (video signals of one field) applied to the display pixels 15 after one horizontal period. When a value corresponding to the high gray level is included in the video signals 22A (video signals of one field) applied to the display pixels 15 after one horizontal period (for example, see FIG. 8A), the drive transistor $Tr_1$ may be driven in the saturated region in all the display pixels 15. Even when a value corresponding to the high gray level is not included in the video signals 22A (video signals of one field) applied to the display pixels 15 after one horizontal period (for example, see FIGS. 8B and 8C), the drive transistor $Tr_1$ may be driven in the saturated region in all the display pixels 15. However, as shown in FIG. 7, since the operating point is considerably greatly separated from the lower end of the saturated region in the intermediate and low gray levels, a value of power-supply voltage $V_{cc}$ is correspondingly excessively increased. In other words, in this case, power consumption is excessively increased.

In the embodiment, the drive transistor $Tr_1$ in each display pixel 15 is set with a value of a minimum power-supply voltage $V_{cc}$ necessary for the operating point to constantly stay in the saturated region. Specifically, a value of power-supply voltage $V_{cc}$ is set such that the operating point is located at the lower end ($V_{ds}=V_{gs}-V_{th}$) of the saturated region in a drive transistor $Tr_1$ in a display pixel 15 applied with a video signal with the maximum luminance among the video signals 22A (video signals of one field) applied to the display pixels 15 after one horizontal period. That is, a value of power-supply voltage $V_{cc}$ is set to the sum ($V_{el}+V_{ds}$) of an anode voltage $V_{el}$ of an organic EL element 11 in the display pixel 15 applied with the video signal with the maximum luminance among the video signals 22A (video signals of one field) applied to the display pixels 15 after one horizontal period and drain-to-source voltage $V_{ds}$ of the drive transistor $Tr_1$. Specifically, a value ($V_{cc}(0)+\Delta V$) given by adding voltage variation $\Delta V$ to an initially set power-supply voltage $V_{cc}(0)$ ($=V_{el}(0)+V_{ds}(0)$) is set as a value of the latest power-supply voltage $V_{cc}$. $V_{el}(0)$ is the initial voltage $V_{el}$ of the organic EL element 11, and $V_{ds}(0)$ is the initial drain-to-source voltage $V_{ds}$ of the drive transistor $Tr_1$ For example, as shown in FIG. 9, it is assumed that initially, anode voltage $V_{el}$ ($=V_{el}(0)$) of the organic EL element 11 is 6 V, drain-to-source voltage $V_{ds}$ ($=V_{ds}(0)$) of the drive transistor $Tr_1$ is 3 V, and power-supply voltage $V_{cc}$ ($=V_{cc}(0)$) is 9V. It is then assumed that an I-V characteristic of the organic EL element 11 is changed, so that anode voltage $V_{el}$ of the organic EL element 11 becomes 7 V. In the embodiment, for example, $\Delta V$ is not set to a value (for example, 3 V) when the operating point is located at the lower end of the saturated region in a white gray level, but set such that the operating point is located at the lower end of the saturated region in the drive transistor $Tr_1$ in the display pixel 15 applied with a video signal with the maximum luminance among video signals 22A (video signals of one field) applied to the display pixels 15 after one horizontal period. For example, a value of voltage variation $\Delta V$ (for example, 1 V), which is obtained when a video signal 22A with the maximum luminance extracted by the video signal processing circuit 22 is outputted to the signal line DTL corresponding to the adjustment pixel 17, is set as a value of $\Delta V$. Then, $\Delta V$ is added to $V_{cc}(0)$, so that 10 V is set as a new power-supply voltage $V_{cc}$. In this way, in the embodiment, a value of power-supply voltage $V_{cc}$ may be reduced in the intermediate and low gray levels compared with a case that a value of power-supply voltage $V_{cc}$ is set such that the operating point is located at the lower end of the saturated region in a white gray level. Consequently, power consumption may be controlled to be low in the intermediate and low gray levels.

The I-V characteristic of the organic EL element 11 shifts into the curve B as shown in FIG. 7 in the case that, for example, panel temperature is lowered (see FIG. 10), or time of current application into the organic EL element 11 is increased (see FIG. 11). Therefore, a drive method according to the embodiment is particularly effective when panel temperature is lowered, or time of current application into the organic EL element 11 is increased.

In the embodiment, a fixed voltage is outputted to the signal line DTL corresponding to the adjustment pixel 17, and a fixed voltage (power-supply voltage $V_{fix}$) is applied from the power line drive circuit 25 to the power line PSL connected to the adjustment pixel 17. Furthermore, the transistor $Tr_5$ is controlled to be on only when the organic EL element 12 in the adjustment pixel 17 emits light, and the transistor $Tr_5$ is controlled to be off when the organic EL element 12 in the adjustment pixel 17 does not emit light. Thus, since the ADC 31 is inputted with voltages only in a narrow range, ADC 31 with a small dynamic range may be used. Furthermore, even if change in voltage $V_{el}$ of the organic EL element 12 is monitored in 0.1 V, ADC 31 with a low-bit gray level may be used. Thus, power consumption may be controlled to be low at low cost.

Modifications

Figure 12:
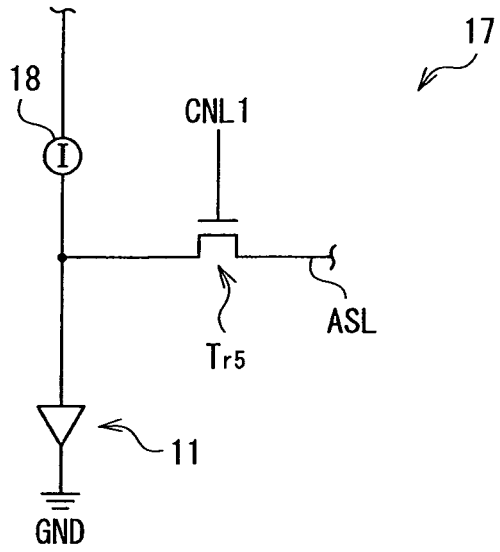
FIG. 12 is a schematic diagram showing a modification of a configuration of an adjustment pixel.

While only one adjustment pixel 17 has been provided in the embodiment, a plurality of adjustment pixels 17 may be provided. Moreover, while the adjustment pixel 17 has been provided in the non-display region 10B, the pixel may be provided in the display region 10A. The adjustment pixel 17 may be a display pixel 15 or a sub pixel 14 in the display region 10A. While the pixel circuit 16 in the adjustment pixel 17 has had the same configuration as that of the pixel circuit 13 in the display pixel 15, the circuit 16 may have a different configuration. For example, as shown in FIG. 12, the pixel circuit 16 in the adjustment pixel 17 may have a simple configuration where the anode of the organic EL element 12 is directly connected with a current source 18, and is connected with the anode signal line ASL, and the transistor $Tr_5$ is inserted in the anode signal line ASL.

While the embodiment has been described with a case, as an example, that the plurality of power lines PSL are electrically separated from one another, and the power lines PSL are sequentially scanned by the power line drive circuit 25, all the power lines PSL may be electrically connected to one another with the power line drive circuit 25 being omitted. In such a case, an output end of the power-supply voltage adjusting circuit 26 may be directly connected to the power lines PSL. However, in such a case, an internal configuration of the pixel circuit 13 or 16 may be different from that as exemplified above.

Moreover, while the power-supply voltage $V_{cc}$ has been adjusted in the embodiment, cathode voltage of the organic EL element 11 may be adjusted.

APPLICATION EXAMPLES

Hereinafter, application examples of the display device 1 described in the embodiment and the modifications thereof will be described. The display device 1 according to the embodiment and the like may be applied to display devices of electronic devices in any field for displaying a still or moving image based on an externally-inputted or internally-generated video signal, the display devices including a television apparatus, a digital camera, a notebook personal computer, a mobile terminal such as mobile phone, and a video camera.

Application Example 1

FIG. 13 shows appearance of a television apparatus using the display device 1 according to the embodiment and the like. The television apparatus has, for example, an image display screen 300 including a front panel 310 and filter glass 320, and the image display screen 300 is configured of the display device 1 according to the embodiment and the like.

Application Example 2

FIGS. 14A and 14B show appearance of a digital camera using the display device 1 according to the embodiment and the like. The digital camera has, for example, a light emitting section for flash 410, a display 420, a menu switch 430 and a shutter button 440, and the display 420 is configured of the display device 1 according to the embodiment and the like.

Application Example 3

Figure 15:
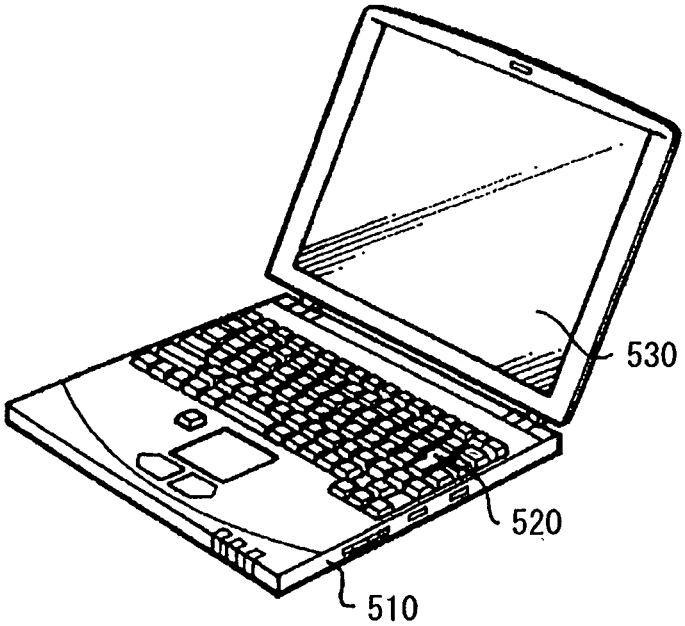
FIG. 15 is a perspective diagram showing appearance of application example 3.

FIG. 15 shows appearance of a notebook personal computer using the display device 1 according to the embodiment and the like. The notebook personal computer has, for example, a body 510, a keyboard 520 for input operation of letters and the like, and a display 530 for displaying images, and the display 530 is configured of the display device 1 according to the embodiment and the like.

Application Example 4

Figure 16:
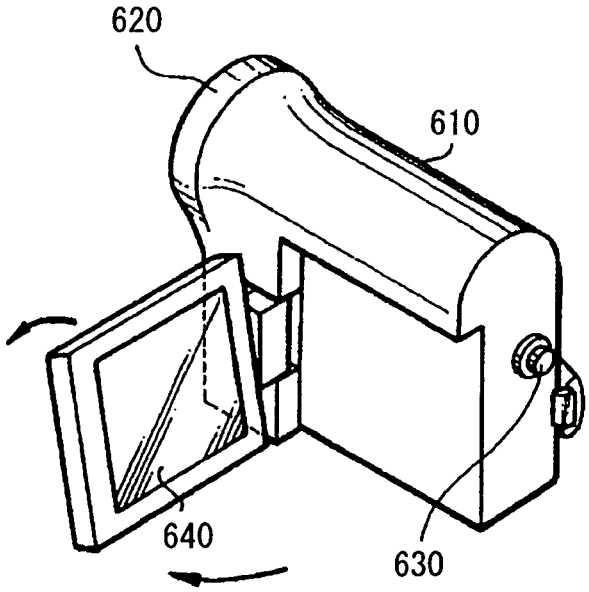
FIG. 16 is a perspective diagram showing appearance of application example 4.
Figures 17A, 17B, 17C, 17D, 17E, 17F, 17G:
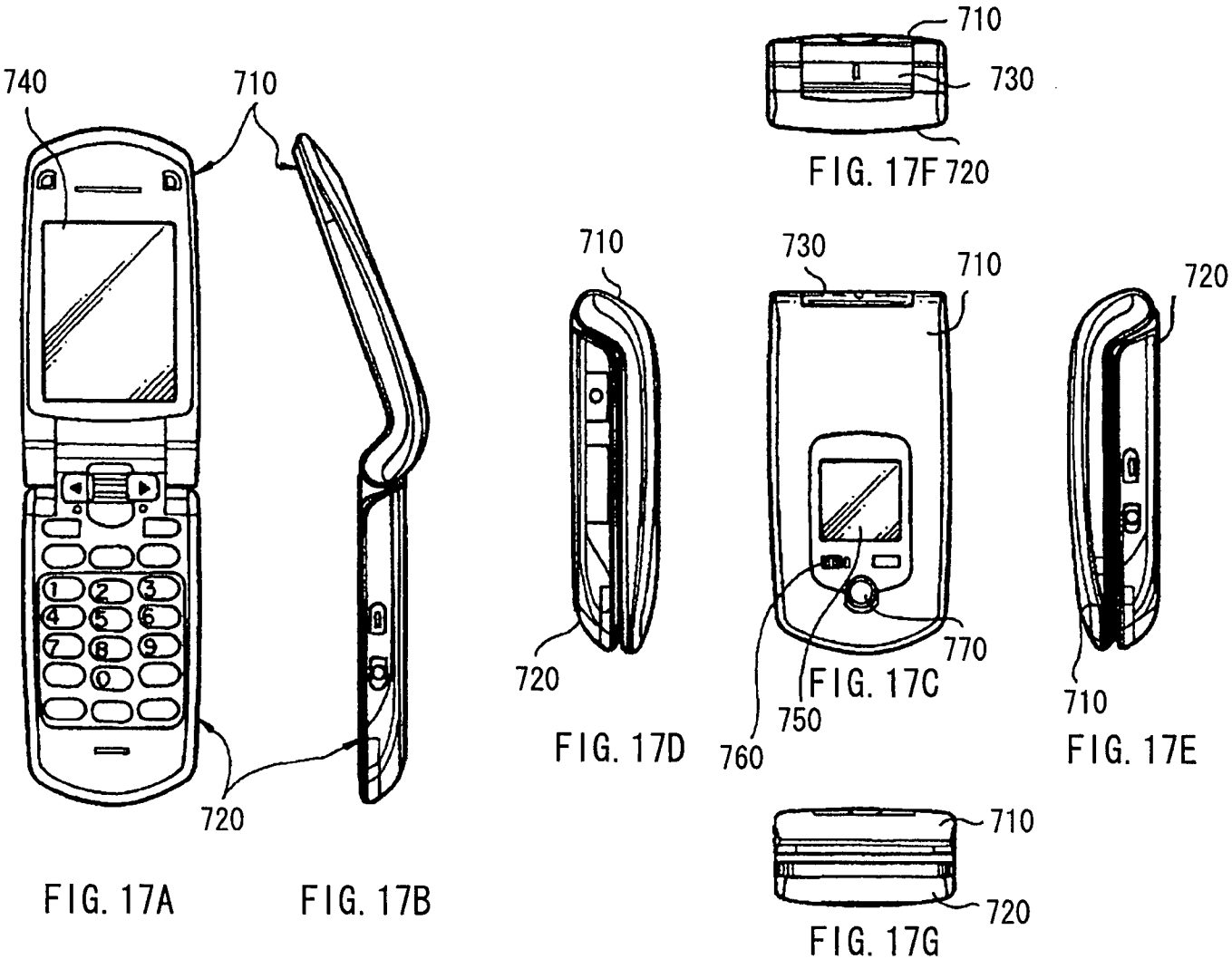
FIGS. 17A to 17G are diagrams of application example 5, where

FIG. 16 shows appearance of a video camera using the display device 1 according to the embodiment and the like. The video camera has, for example, a body 610, an object-shooting lens 620 provided on a front side-face of the body 610, a start/stop switch 630 for shooting, and a display 640. The display 640 is configured of the display device 1 according to the embodiment and the like.

Application Example 5

FIGS. 17A to 17G show appearance of a mobile phone using the display device 1 according to the embodiment and the like. For example, the mobile phone is assembled by connecting an upper housing 710 to a lower housing 720 by a hinge 730, and has a display 740, a sub display 750, a picture light 760, and a camera 770. The display 740 or the sub display 750 is configured of the display device 1 according to the embodiment and the like.

The present application contains subject matter related to that disclosed in Japanese Priority Patent Application JP 2009-277814 filed in the Japan Patent Office on Dec. 7, 2009, the entire content of which is hereby incorporated by reference.

It should be understood by those skilled in the art that various modifications, combinations, sub-combinations and alterations may occur depending on design requirements and other factors insofar as they are within the scope of the appended claims or the equivalent thereof.

What is claimed is:

1. A display device comprising:

a plurality of display pixels that are arranged two-dimensionally and have first light emitting elements;

at least one adjustment pixel that has a reference light emitting element;

a drive section configured to drive the plurality of display pixels to emit light at respective gradations corresponding to respective video signals input to the plurality of display pixels and to drive the at least one adjustment pixel to emit light at a gradation corresponding to an adjustment-pixel signal; and a processing section configured to set a value of the adjustment-pixel signal during a given field period to be no larger than a largest value of the video signals input to the plurality of display pixels during the given field period, wherein the drive section is configured to apply a display power-supply voltage to the plurality of display pixels when they emit light, the display power-supply voltage is variably set to a value depending on a voltage variation of the reference light emitting element when the reference light emitting element emits light, and wherein the processing section is configured to, during the given field period, update a value of the adjustment-pixel signal every horizontal scanning period such that the value of the adjustment-pixel in the horizontal scanning period in which the update is performed is no larger than a largest value of the video signals input to the plurality of display pixels from the start of the given field period to the horizontal scanning period in which the update is performed.

2. The display device of claim 1, wherein the drive section is configured to determine the voltage variation of the reference light emitting element by monitoring a voltage value of the reference light emitting element only when the reference light emitting element emits light.

3. The display device of claim 2, wherein a monitoring node of the adjustment pixel, which is used for monitoring a voltage value of the reference light emitting element, is connected to the drive section via a switching element, and the drive section applies a control signal to the switching element so that the switching element is on only when the reference light emitting element emits light.

4. The display device of claim 1, wherein the drive section is configured to determine the voltage variation of the reference light emitting element by comparing a voltage value of the reference light emitting element when the reference light emitting element emits light to a reference voltage value.

5. The display device of claim 4, wherein the driving section is configured to generate the display power-supply voltage by adding the voltage variation of the reference light emitting element to a predetermined voltage value corresponding to the adjustment-pixel signal.

6. The display device of claim 5, wherein, when the display power-supply voltage is designated as $V_{cc}$, then the following equation is satisfied:

$$V_{cc}=V_{sig_adj}-V_{TH}+V_{EL}+\Delta V,$$

where $V_{sig_adj}$ is a present value of the adjustment-pixel signal, $V_{TH}$ is a threshold voltage of a drive transistor of the adjustment pixel, $V_{EL}$ is a predetermined value equal to an initial voltage of the reference light emitting element when the adjustment pixel is driven to emit light with an adjustment-pixel signal having a value equal to $V_{sig_adj}$, and $\Delta V$ is the voltage variation of the reference light emitting element.

7. The display device of claim 1, wherein an adjustment power-supply voltage of a fixed value is applied to the adjustment pixel when it emits light.

8. The display device of claim 1, wherein each display pixel has a first transistor controlling electric current flowing into the first light emitting element, and a second transistor writing a signal voltage corresponding to the video signal to a gate of the first transistor, a first current electrode of the first transistor is connected to the first light emitting element, and a second current electrode of the first transistor is connected to a power supply line.

9. The display device of claim 1, wherein the display pixels are disposed in a display region and the at least one adjustment pixel is disposed in a non-display region.

10. A display device comprising:

a plurality of display pixels that are arranged two-dimensionally and each have a first light emitting element and a drive transistor; and at least one adjustment pixel that has a reference light emitting element;

a drive section configured to drive the plurality of display pixels to emit light at respective gradations corresponding to respective video signals input to the plurality of display pixels, wherein the drive section is configured to apply a display power-supply voltage to the plurality of display pixels when they emit light, a processing section configured to set a value of an adjustment-pixel signal during a given field period to be no larger than a largest value of the video signals input to the plurality of display pixels during the given field period, and a value of the display power-supply voltage is variably set such that, during a given field period, the value of the display power-supply voltage is a smallest value that will ensure that, for each of the plurality of display pixels an operation point of the light emitting element thereof during the given field period is within a saturation region of the drive transistor thereof, wherein the drive section is configured to drive the adjustment pixel to emit light at a gradation corresponding to the adjustment-pixel signal, determine a voltage variation of the reference light emitting element when it emits light, and generate the display power-supply voltage by adding the voltage variation of the reference light emitting element to a predetermined voltage value that corresponds to the adjustment-pixel signal, and wherein the processing section is configured to, during the given field period, update a value of the adjustment-pixel signal every horizontal scanning period such that the value of the adjustment-pixel in the horizontal scanning period in which the update is performed is no larger than a largest value of the video signals input to the plurality of display pixels from the start of the given field period to the horizontal scanning period in which the update is performed.

11. The display device of claim 10, wherein when the display power-supply voltage is designated as $V_{CC}$, then the following equation is satisfied:

$$V_{CC}=V_{DS}+V_{EL}+\Delta V,$$

where $V_{DS}$ is a predetermined value equal to a minimum potential that is within a saturation region of a drive transistor of the adjustment pixel when it is driven to emit light with an adjustment-pixel signal having a value equal to a present value of the adjustment-pixel signal, $V_{EL}$ is a predetermined value equal to an initial voltage of the reference light emitting element when the adjustment pixel is driven to emit light with an adjustment-pixel signal having a value equal to a present value of the adjustment-pixel signal, and $\Delta V$ is the voltage variation of the reference light emitting element.

12. The display device of claim 11, wherein $V_{DS}$ equals a present value of the adjustment-pixel signal minus a threshold voltage of a drive transistor of the adjustment pixel.

13. A method of driving a display device comprising a plurality of display pixels that are arranged two-dimensionally and have first light emitting elements and at least one adjustment pixel that has a reference light emitting element, the method comprising:

causing the plurality of display pixels to emit light at respective gradations corresponding to respective video signals input to the plurality of display pixels and causing the at least one adjustment pixel to emit light at a gradation corresponding to an adjustment-pixel signal;

setting a value of the adjustment-pixel signal during a given field period to be no larger than a largest value of the video signals input to the plurality of display pixels during the given field period;

applying a display power-supply voltage to the plurality of display pixels when they emit light;

variably setting the display power-supply voltage to a value depending on a voltage variation of the reference light emitting element when the reference light emitting element emits light, and wherein during the given field period, updating a value of the adjustment-pixel signal every horizontal scanning period such that the value of the adjustment-pixel in the horizontal scanning period in which the update is performed is no larger than a largest value of the video signals input to the plurality of display pixels from the start of the given field period to the horizontal scanning period in which the update is performed.

* * * * *